United States Patent [19]

Lee

[11] 4,417,432

[45] Nov. 29, 1983

[54] POWER POST FOR FILM FRAME FOR SKIN PACKAGING MACHINE

[75] Inventor: Cleve L. Lee, Anderson, S.C.

[73] Assignee: Nordson Corporation, Amherst, Ohio

[21] Appl. No.: 268,885

[22] Filed: Jun. 8, 1981

Related U.S. Application Data

[63] Continuation-in-part of Ser. No. 252,140, Apr. 8, 1981.

[51] Int. Cl.[3] ..... B65B 57/00; B65B 53/02

[52] U.S. Cl. ..... 53/77; 53/509; 53/557; 74/37

[58] Field of Search ..... 53/77, 509, 427; 219/385, 405, 411; 74/37, 582

[56] References Cited

U.S. PATENT DOCUMENTS

| | | | |
|---|---|---|---|
| 1,641,067 | 8/1927 | Connelly | 74/37 |
| 3,102,696 | 9/1963 | Larsh | 74/37 X |
| 3,449,886 | 6/1969 | Connelly et al. | 53/427 |
| 3,501,886 | 3/1970 | Watts, Jr. et al. | 53/427 |
| 4,118,993 | 10/1978 | Miyoshi et al. | 74/37 |

*Primary Examiner*—Horace M. Culver

*Attorney, Agent, or Firm*—Wood, Herron & Evans

[57] ABSTRACT

In a skin packaging machine, a mechanism for raising and lowering the film frame. The mechanism includes a single vertical post, a vertical shaft alongside the post, a carriage assembly slidably mounted on the vertical shaft. A laterally projecting arm and slide block cooperate with a slide rail on the vertical post to prevent the swiveling or rotating of the assembly as it rides up and down the shaft. A chain passing around upper and lower sprockets is driven by a reversible alternating current motor. The chain is connected to the carriage assembly through two series connected springs. The springs serve as chain tensioners as well as shock absorbers in the event that the assembly, including the frame, engages an object during its upward or downward excursion.

9 Claims, 5 Drawing Figures

POWER POST FOR FILM FRAME FOR SKIN PACKAGING MACHINE

This is a continuation-in-part of my copending application Ser. No. 252,140, filed Apr. 8, 1981.

This invention relates to a skin packaging machine, and more particularly, the invention relates to the structure and mechanism for supporting a film heating oven and for raising and lowering a film carrying frame with respect to the oven.

BACKGROUND OF THE INVENTION

Prior art skin packaging machines have included a base, at least two vertical posts at the rear corners of the base which support an oven which heats the skin packaging film. The posts also contain two drive transmissions which are connected to the clamp or frame which carries the film up to the oven for the purpose of heating it and which carries the film down upon the base for the purpose of placing it across the article to be skin packed. The transmission mechanism can be a pair of pneumatic piston and cylinder combinations or, alternatively, it can be a pair of chain drives passing over upper and lower motor-driven sprockets in each supporting post.

SUMMARY OF THE INVENTION

It has been an objective of the invention to reduce the cost of the skin packaging machine.

It has been another objective of the invention to increase the safety to the operator of the skin packaging machine.

To this end, the invention provides a single post and a single transmission mechanism supported by the post for raising and lowering the film frame.

Associated with such a single post, it is preferred, at least for the sake of economy, to employ a chain drive powered by an alternating current motor as contrasted to pneumatic piston and cylinder combinations for raising and lowering the frame. The pneumatic system requires a compressor to develop the air pressure required for operating the system. This added expense is not required with the chain transmission system of the present invention.

The invention further provides for a single vertical shaft upon which a carriage assembly is slidably mounted. The carriage assembly supports the film frame and is connected to the chain so that by operating the reversible motor, the carriage assembly can be raised and lowered. The carriage assembly includes a laterally projecting arm or rod which terminates in a guide block. The guide block cooperates with a slide rail mounted on the vertical post to prevent the carriage assembly from swiveling or rotating with respect to the shaft.

The invention further provides for a torque limiter between the AC motor and the chain sprocket. The torque limiter may be adjusted to carry just a few foot pounds of torque in excess of that required to raise the frame, thereby further limiting the force that would be applied to an object in the path of a frame.

Still further, the invention provides, in association with the torque limiter, a one-way roller clutch bearing connected between the drive motor and the chain sprocket, the one-way roller clutch bearing being oriented so as to engage when power is applied to raise the carriage assembly. The one-way clutch provides a safety feature which prevents the carriage assembly from being driven positively downwardly upon a limb of the operation of the skin packaging machine. During downward movement of the carriage, the motor rotates in a direction to permit the carriage assembly to lower by the force of gravity, but the one-way clutch does not permit the motor to apply any downward force at all to the carriage. If the carriage should engage the hand, for example, of the operator, the only force upon the operator's hand would be that of the weight of the carriage.

The several objectives and features of the invention will become more readily apparent from the following detailed description taken in conjunction with the accompanying drawings in which.

Figure 1:
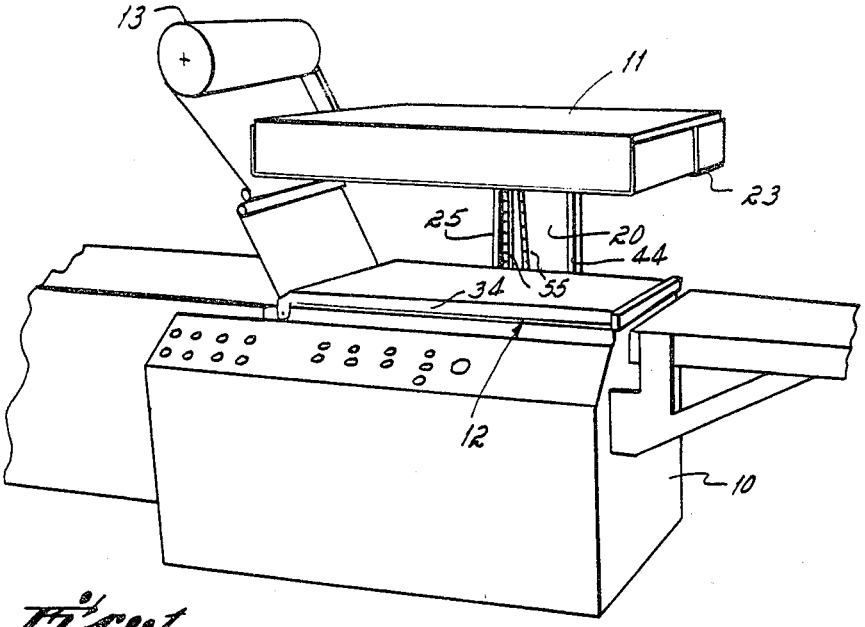
FIG. 1 is a diagrammatic perspective view of a skin packaging machine with which the present invention is employed.

The basic elements of a skin packaging machine are old and well known. As diagrammatically illustrated in FIG. 1, they include a base 10 having a perforated plate and a source of vacuum for application to the perforated plate. An oven 11 is mounted over the plate for the purpose of heating a film from a supply roll 13 which is to be drawn down onto a substrate mounted on the perforated plate in order to surround an article which is to be packaged on the substrate. A film frame or clamp 12 is mounted above the base 10 and carries a film between two jaws which form the frame. The film, heated by the oven when the frame is in a raised position, is thereafter placed upon the substrate on the base 10 when the frame is in a lowered position. A mechanism is provided for moving the frame 12 from a position adjacent the oven 11 to a position adjacent the base 10. In machines where the skin packaging operation is largely a manual one, it is desirable that the frame 12 be provided with a mechanism for lessening the impact upon an object which is in the path of the movement of the frame as, for example, the arm or hand of an operator in charge of the machine.

Figure 2:
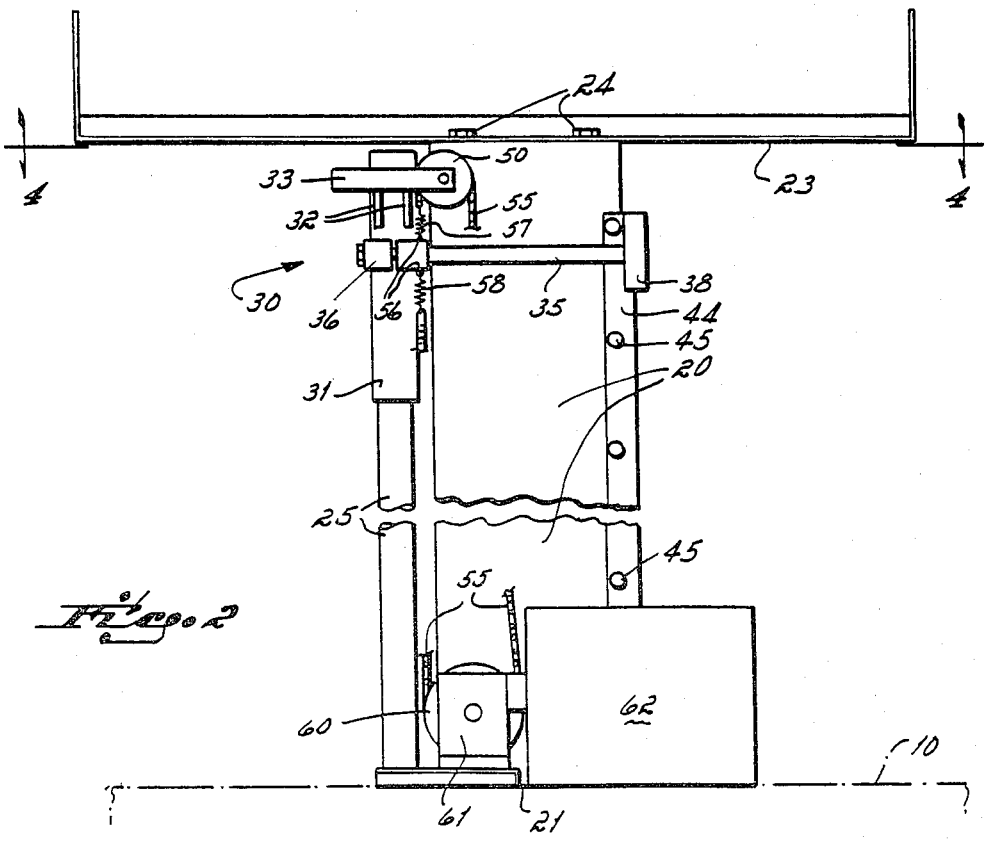
FIG. 2 is a front elevational view of the invention.
Figure 3:
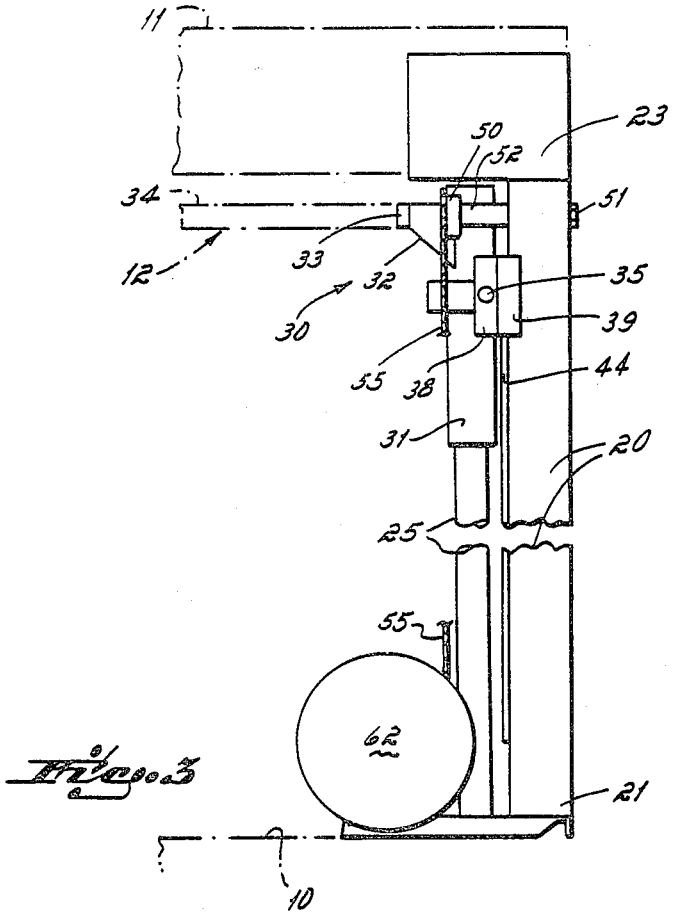
FIG. 3 is a side elevational view of the invention.
Figure 4:
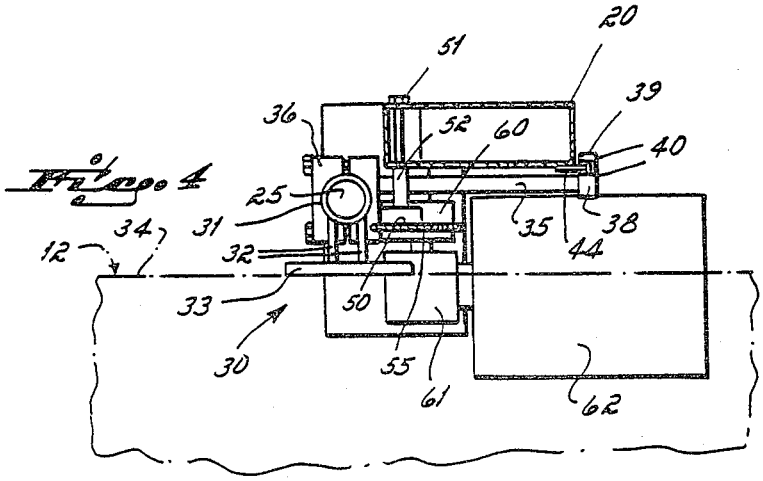
FIG. 4 is a top plan view of the invention.

As has been indicated above, it has been an objective of the present invention to provide a mechanism for raising and lowering the frame 12 and to mount that mechanism on a single post. That post and mechanism are illustrated in FIGS. 2 through 4.

Referring to those figures, a vertical post 20 is mounted at its lower end 21 on the base 10. At its upper end the post 20 has a bracket 23 secured to it by bolts 24, the bracket 23 forming an oven support for the oven 11.

A vertical shaft 25 is mounted between the oven support bracket 23 and the base 10. A carriage assembly 30 is slidably mounted on the shaft 25. The carriage assembly includes a tube 31 carrying within it bushings which permit it to slide freely up and down the shaft 25. The tube 31 has a pair of triangular brackets 32 mounted at its upper end. The triangular brackets carry a horizontal bar 33 which functions as a support for the bottom half of a film carrying frame 34 (shown in phantom in FIG. 4).

The carriage assembly further includes a horizontal bar or arm 35 which is clamped by an aligning clamp 36 to the tube 31. The horizontal bar has at one end a channel-shaped guide block 38 having a vertical channel 39. The channel 39 is lined with high density molecular weight polyethylene slide strips on both sides as indicated at 40. The guide block cooperates with a vertical slide rail 44 which is mounted by bolts 45 to the vertical post 20 and is spaced laterally a substantial distance from the vertical shaft 25. The guide block 38 and horizontal rod 35 serve to block rotation or swiveling of the carriage assembly around the shaft 25 during the operation of the skin packaging machine.

Mechanism is provided for raising and lowering the carriage assembly. An upper sprocket 50 is mounted on the vertical post 20 by means of a bolt 51 and a bronze bushing 52. A lower sprocket/torque limiter assembly 60 is suitably mounted on the lower end 21 of the post 20. A chain 55 passes around the two sprockets and is connected by a chain fastener 56 to the carriage assembly. An upper spring 57 and a lower spring 58 are mounted on either side of the carriage assembly and in series with the chain. The springs are tension springs which serve to take up the slack in the chain and cushion the impact of the carriage assembly and film frame which it carries on any object in the path of the film frame as it moves up and down.

The lower sprocket/torque limiter 60 is a driving sprocket whch is connected through a gear box 61 to a reversible AC motor 62. The torque limiter provides a second order of protection against injury as well as to the equipment in that it limits the force that the motor can impart to the frame and carriage when either engages an object in its path during an upward or downward excursion of the carriage and film frame.

Figure 5:
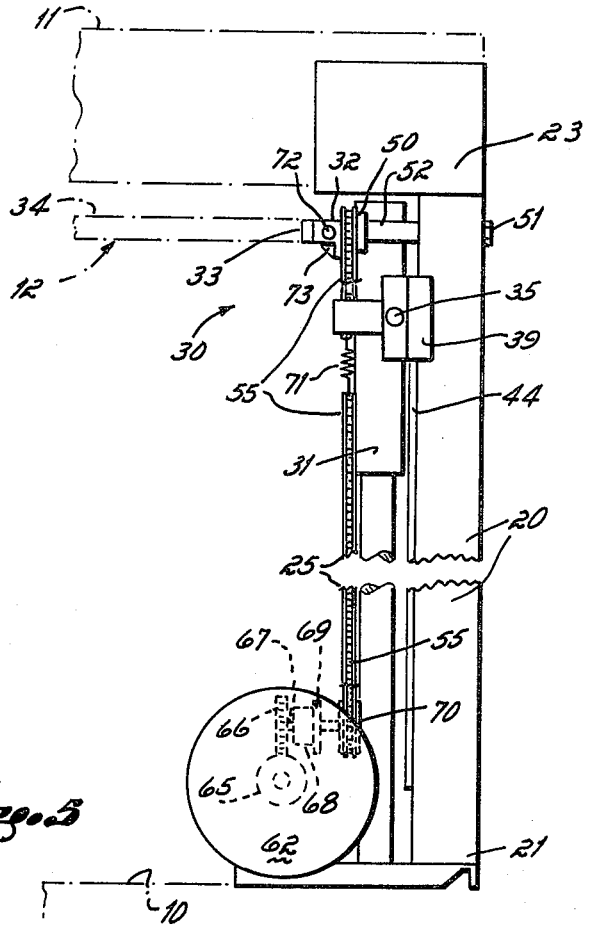
FIG. 5 is a diagrammatic side elevational view of an alternative embodiment of the invention.

In the embodiment of FIG. 5, the motor 62 drives a worm shaft 54 which in turn drives a spur gear 66. The spur gear is connected by a shaft 67 to a torque limiter 68 to which a one-way roller clutch bearing 69 is connected. The output of the roller clutch bearing is connected to the sprocket 70 to raise the chain 55. The roller clutch bearing preferably is of the known type formed by three needle bearings, placed side by side, with the center needle bearing having spring-urged rollers and ramps which tend to urge the rollers upwardly against the sleeve forming the outside of the bearing to cause the engagement of the rollers with the outer sleeve for driving the outer sleeve and the sprocket to which it is connected in the direction which will cause it and the associated chain 55 to raise the carriage assembly including the frame. While the needle bearing type roller clutch bearing is preferred, it should be understood that it is within the scope of the invention to employ other commonly used one-way clutches for connecting the motor to the sprocket 70. The important relationship that must be employed is that the clutch engage when the motor rotates in that direction which will raise the carriage assembly and will disengage when the motor is rotated in a direction to lower the carriage assembly.

In this embodiment of the invention, only a single tension spring 71 is employed in the chain, the primary function of the spring being to take up the slack in the chain.

Another structural feature of this embodiment consists of the mounting of the frame at its rear end about a pivot axis 72 on the brackets 32. A stop 73 is provided which prevents the frame 34 from swinging downwardly past a horizontal position but will permit the frame to swing upwardly. It is to be noted that the pivotal mounting of the frame has been employed in prior skin packaging machines.

Suitable controls as, for example, limit switches, are provided to determine the limits of the upward and downward excursion of the carriage during the normal operation of the apparatus.

In the operation of the invention, the operator begins the operation by pushing a control button which causes the carriage assembly 30 to rise to the position of FIG. 2 where engagement with a limit switch causes it to stop. The operator then places a card with the merchandise to be packaged on a perforated plate on the base 10.

Another button to start the cycle is pushed and the oven heaters are energized with full power. At the end of a predetermined period of time, the film becomes droopy and the carriage assembly lowers the frame, placing the film over the card with the article of merchandise. Substantially simultaneously, turbines are energized to cause a vacuum to be drawn through the perforated plate and the card so as to pull the film down upon the card and the article.

Again, after a predetermined period of time, the vacuum is turned off and the frame is opened up. The operator moves the product laterally away from the frame, thereby pulling a fresh supply of film into the frame. The frame clamp is then closed. A cut-off knife is operated either manually or automatically to cut off the now packaged product from the fresh supply of film. At this point, the cycle of operations is ready to be begun again.

During the raising and lowering of the carriage assembly and frame, there will be a tendency of the frame to swivel with respect to the shaft 25. The guide block 38 and rod or arm 35 cooperating with the slide rail 44 prevents that swiveling and maintains the frame in the proper orientation with the oven at its upward position and with the perforated vacuum plate at its lower position.

If an object such as the arm or hand of the operator should inadvertently be in the path of the frame as it moves in one or the other directions of its excursion, the spring 57 or 58, depending upon the direction of movement, will lessen the impact of the frame on the operator. Finally, the torque limiter will limit the ultimate pressure that the motor will apply to the frame until the operator can turn off the power to the motor. The torque limiter 60 can be adjusted so as to apply just a few pounds more than the force required to raise and lower the frame and carriage assembly.

In the case of the embodiment of FIG. 5, if an object such as the arm or hand of the operator should inadvertently be in the path of the frame as it moves in a downward direction, the force upon such object will be no greater than the weight of the carriage assembly since the one-way clutch 69 will prevent the motor 62 from imparting any downward force on the carriage assembly. The motor will simply continue to run with its output shaft rotating freely in the overrunning clutch until the problem has been corrected.

Having described my invention, I claim:

1. In a skin packaging machine, a single post mount for a film frame comprising, a base, a single vertical post mounted at its lower end on said base at the center of one side of said base, an oven mounted on the upper end of said post, sprockets mounted at the upper and lower ends of said post, a chain passing around said sprockets, a vertical shaft mounted between said base and said oven, a carriage assembly slidably mounted on said shaft, a film frame mounted on said carriage assembly, said chain being connected to said carriage assembly to raise and lower said film frame as said sprockets are rotated, a drive motor connected to one of said sprockets, a one-way clutch interposed between said drive motor and one of said sprockets to permit application of a driving force to said sprocket only to raise said carriage assembly, and means for preventing rotating of said carriage assembly with respect to said shaft, said single post leaving substantial area around the machine for access to the machine from front and rear for maintenance and the like.

2. Apparatus as in claim 1 further comprising:

a torque limiter interposed between said motor and said sprocket.

3. Apparatus as in claim 1 further comprising, a vertical slide rail mounted on said vertical post and spaced from said shaft, a rod projecting laterally from said carriage assembly, a guide block mounted on the end of said rod and slidable on said guide rail to block rotation of said carriage assembly with respect to said shaft.

4. In a skin packaging machine, a single post mount for a film frame comprising, a base, a single vertical post mounted at its lower end on said base at the center of one side of said base, an oven mounted on the upper end of said post, sprockets mounted at the upper and lower ends of said post, a chain passing around said sprockets, a vertical shaft mounted between said base and said oven, a carriage assembly slidably mounted on said shaft, a film frame mounted on said carriage assembly, said chain being connected to said carriage assembly to raise and lower said film frame as said sprockets are rotated, a drive motor connected to one of said sprockets, and means for preventing rotating of said carriage assembly with respect to shaft shaft, said single post leaving substantial area around the machine for access to the machine from front and rear for maintenance and the like.

5. Apparatus as in claim 4 further comprising, a torque limiter interposed between said motor and said sprocket.

6. Apparatus as in claim 4 or 5 further comprising at least one tension spring in series with said chain to take up slack in said chain and to cushion impact of said carriage assembly on an object in the path of its movement.

7. Apparatus as in claim 4 or 5 further comprising a pair of tension springs in series with said chain, one spring mounted on each side of said carriage assembly.

8. Apparatus as in claim 4 in which said rotation preventing means comprises, a vertical slide rail mounted on said vertical post and spaced from said shaft, a rod projecting laterally from said carriage assembly, a guide block mounted on the end of said rod and slidable on said guide rail to block rotation of said carriage assembly with respect to said shaft.

9. In skin packaging apparatus, frame elevating mechanism comprising, a base, a single vertical post mounted at its lower end on said base at the center of one side of said base, an oven supported by said post, upper and lower sprockets, mounted on said post, a reversible motor driving one of said sprockets, a continuous chain passing around said sprockets, a frame connected to said chain, and at least one tension spring in series with said chain and joining the ends of said chain together to cushion the impact of said frame on an object in the path of said frame.

* * * * *